US007381061B2

(12) United States Patent
Hung et al.

(10) Patent No.: US 7,381,061 B2
(45) Date of Patent: Jun. 3, 2008

(54) HIGH DENSITY ELECTRICAL CONNECTOR

(75) Inventors: Yi-Ching Hung, Taoyuan Hsien (TW); Chien-Yu Hsu, Taoyuan Hsien (TW); Robert Chiang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/566,230

(22) Filed: Dec. 3, 2006

(65) Prior Publication Data

US 2008/0045045 A1 Feb. 21, 2008

(30) Foreign Application Priority Data

Aug. 21, 2006 (TW) ..... 95130728 A

(51) Int. Cl.
*H01R 12/00* (2006.01)

(52) U.S. Cl. ..... 439/66

(58) Field of Classification Search ..... 439/66, 439/591, 733.1, 857
See application file for complete search history.

(56) References Cited

U.S. PATENT DOCUMENTS

| | | | | |
|---|---|---|---|---|
| 5,387,121 | A | 2/1995 | Kurz | |
| 6,193,561 | B1 | 2/2001 | Harting et al. | |
| 6,439,934 | B1 * | 8/2002 | Yu | 439/733.1 |
| 6,464,537 | B1 | 10/2002 | Letourneau et al. | |
| 6,877,992 | B2 * | 4/2005 | Grant et al. | 439/66 |
| 6,913,469 | B2 * | 7/2005 | Chiang | 439/66 |

* cited by examiner

*Primary Examiner*—Renee S Luebke
*Assistant Examiner*—Vanessa Girardi
(74) *Attorney, Agent, or Firm*—Pai Patent & Trademark Law Firm; Chao-Chang David Pai

(57) ABSTRACT

A high density electrical connector to connect an electronic device and a printed circuit board includes a connector body disposed on the printed circuit board, several terminal channels disposed in the connector body, and several terminals disposed in the terminal channels. The printed circuit board has several contact points. Each terminal has an extending portion to connect with the contact points of the printed circuit board. Another end of the terminal has a joint generated by separating with a carrier. A method for assembling the high density electrical connector is also disclosed.

8 Claims, 5 Drawing Sheets

HIGH DENSITY ELECTRICAL CONNECTOR

RELATED APPLICATIONS

The present application is based on, and claims priority from, Taiwan Application Serial Number 95130728, filed Aug. 21, 2006, the disclosure of which is hereby incorporated by reference herein in its entirety.

BACKGROUND

1. Field of Invention

The present invention relates to an electrical connector. More particularly, the present invention relates to a high density electrical connector.

2. Description of Related Art

Electrical connectors are common electrical apparatus that provide an individual connecting structure to stably transmit signals between two electronic devices. The signal and a current between the electronic devices are transmitted by a number of terminals, thus terminal design is quite important to the electrical connector.

Refer to FIG. 6. FIG. 6 illustrates an oblique diagram of an electrical connector of U.S. Pat. No. 6,464,537. The electrical connector 20 is an electrical card edge connector utilized to connect a daughter board and a motherboard 30. The daughter board is vertically inserted into a terminal channel 22 of the electrical connector 20 and is in contact with terminals 24 on both sides of the terminal channel 22 to connect the daughter board with the motherboard 30 via the terminals 24. The electrical connector 20 may have several baffles 26 disposed between the daughter board and the terminals 24 to guide the daughter board and protect the terminals 24 from a crashing deformation caused by improper assembly.

Refer to FIG. 7. FIG. 7 illustrates a lateral view diagram of an electrical connector of U.S. Pat. No. 6,193,561. The electrical connector 40 connects an electronic device and a printed circuit board 50. A butt terminal of the electronic device may be inserted into a terminal channel 42 of the electrical connector 40 and be in contact with a terminal 44 in the terminal channel 42. The terminal 44 may electrical connect the electronic device and the printed circuit board 50 by an extending portion 45 mounted on the printed circuit board 50. The electrical connector 40 may also have at least a baffle 46 disposed between the electronic device and the terminal 44 for guiding the electronic device and protecting the terminal 44 from a crashing deformation caused by improper assembly.

In the above electrical connector assembly, the terminals are connected on a carrier and inserted into the electrical connector from a downside to an upside. Then the extending portions of the terminals are separated from the carrier and mounted at the contact points on the printed circuit board to electrically connect the printed circuit board and the electronic device. However, computer peripherals and electronic devices are becoming smaller and therefore need for a high density electrical connectors is becoming larger. In the high density electrical connector, if one of the extending portions cannot be mounted to the contact point completely or properly, the high density electrical connector may not work well. Thus the smoothness of the extending portion is really important.

To separate the extending portions from the carrier, the extending portions are bent and a joint is generated on the extending portion. Separating the terminals from the carrier may cause a bending deformation to the terminals and reduce the smoothness of the extending portions and the accuracy of mounting the terminals onto the contact points is difficult to control.

Refer to FIG. 8. FIG. 8 illustrates a lateral view diagram of another electrical connector. The electrical connector 60 is utilized to connect a central processing unit (CPU). The electrical connector 60 includes an upper cover 66 and a base 67. The base 67 includes several terminal channels 64 and each terminal channel 64 may have a terminal 70 inserted. The upper cover 66 has several terminal passages 68 disposed corresponding to the terminal channels 64 respectively. The upper cover 66 may slide relative to the base 67. Butt terminals 70 of the CPU must be adjusted to the terminal passage 68, the CPU is then inserted into the terminal channels 64 to be in contact with the terminals 62 in the electrical connector 60 and to establish an electrical connection between the CPU and the printed circuit board.

In the electrical connector 60, the terminal channels 64 of the base 67 may fix the terminals 62. The terminals 62 may be inserted into the base 67 from an upside or a downside of the base 67, but the bending deformation of the extending portion caused by separating terminals 62 from the carrier may not be prevented when the terminals 62 are inserted into the terminal channels 64 from the downside of the base 67.

The upper cover 66 of the electrical connector 60 for the CPU may protect the terminals 62 from the crashing deformation when inserting the butt terminals 70 as the baffle 26 in FIG. 6. The bending deformation of the extending portion of the terminals 62 may not be solved and the upper cover 66 may complicate the structure of the electrical connector 60.

For the forgoing reasons, there is a need for a high density electrical connector to improve the mounting accuracy between the extending portion of the terminals and the printed circuit board and improve the fabricating quality of the electrical connector.

SUMMARY

It is therefore an objective of the present invention to provide a high density electrical connector to electrically connect an electronic device and the printed circuit board.

The high density electrical connector includes a connector body, a plurality of terminal channels, and a plurality of terminals. The connector body is disposed on the printed circuit board and has a plurality of terminal channels. Each terminal channel is extended in the connector body from a side near to the printed circuit board to an opposite side. The terminal channels are divided by a plurality of dividing walls, wherein each dividing wall has a shoulder disposed far to the printed circuit board. The terminals are disposed in the terminal channels and each terminal has at least one elastic arm and each elastic arm has a guiding portion extended far to the printed circuit board and a part of the guiding portion is disposed near to the shoulder of the dividing wall.

The invention also provides a method for assembling the connector body of the high density electrical connector with a plurality of terminals joint on a carrier. The assembling method includes inserting the terminals into the terminal channels of the connector body respectively from a top of the connector body far to the printed circuit board; separating the terminals and the carrier; and mounting the terminals and the printed circuit board.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
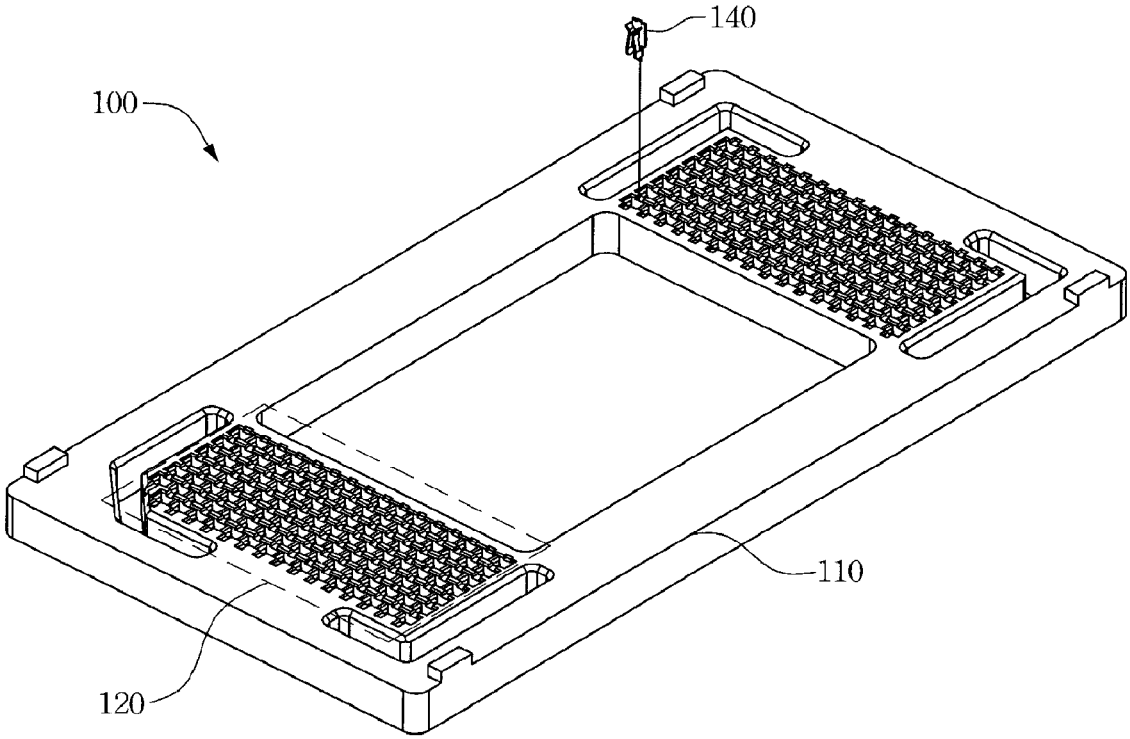
FIG. 1 is an assembling schematic diagram of an embodiment of a high density electrical connector of the invention.

Reference will now be made in detail to the present preferred embodiments of the invention, examples of which are illustrated in the accompanying drawings. Wherever possible, the same reference numbers are used in the drawings and the description to refer to the same or like parts.

Refer to FIG. 1. FIG. 1 illustrates an assembling schematic diagram of an embodiment of a high density electrical connector of the invention. The high density electrical connector 100 may connect a printed circuit board and an electronic device. The high density electrical connector 100 includes a connector body 110 made of an isolation material, a plurality of terminal channels 130 disposed in the connector body 110, and a plurality of terminals 140 disposed in the terminal channels 130 respectively to transmit electrical signals. The terminal channels 130 are extended in the connector body 110 from a side near the printed circuit board to an opposite side and cross through the connector body 110. The terminals 140 of the high density electrical connector 100 are inserted into the terminal channels 130 of the connector body 110 respectively from a top of the connector body 110 far to the printed circuit board. The electronic device has a plurality of butt terminals to insert into the corresponding terminal channels 130 and to be into contact with the terminals 140 in the terminal channels 130. Thus the electronic device may electrically connect with the printed circuit board through the terminals 140 of the high density electrical connector 100.

Figure 2:
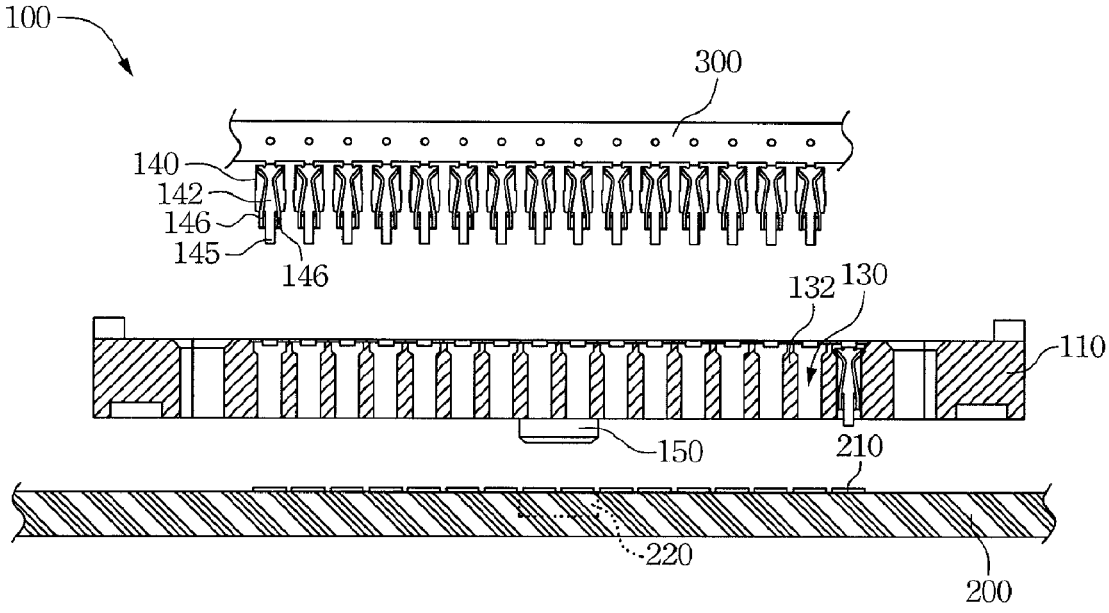
FIG. 2 is an assembling section view diagram of an embodiment of the electrical connector of the invention.
Figure 3:
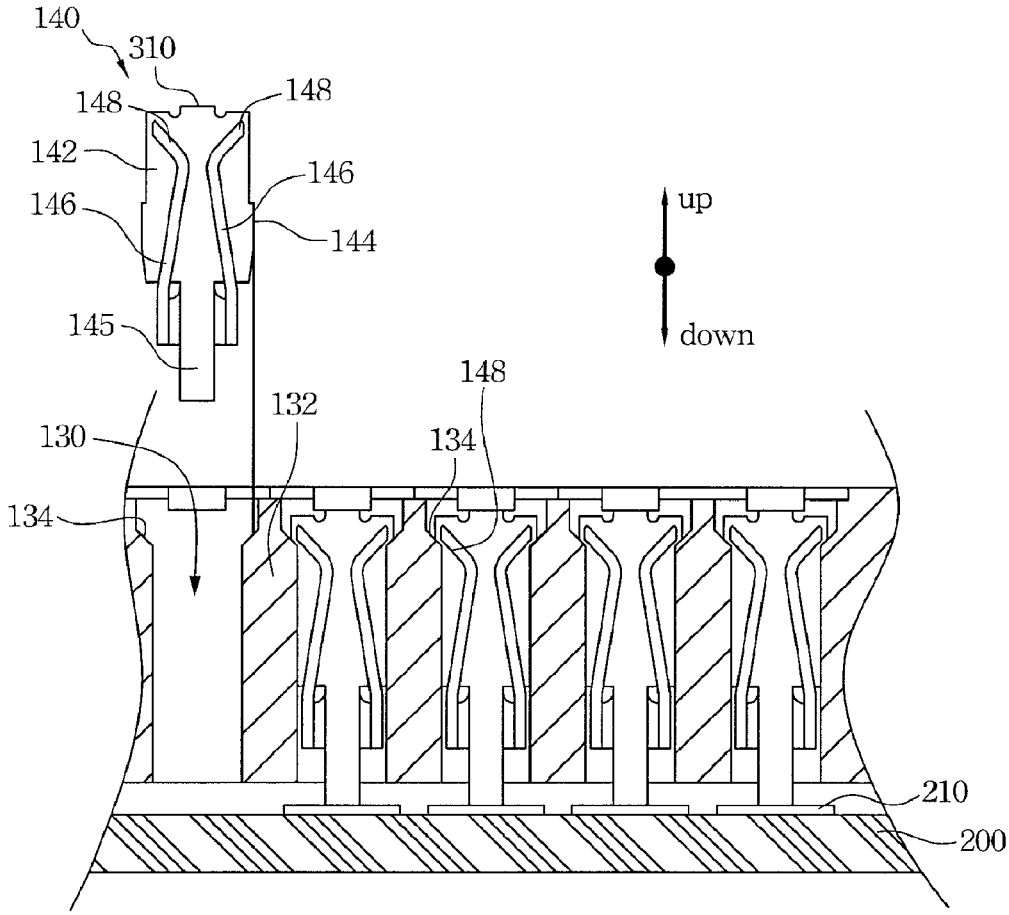
FIG. 3 is a partial enlarged diagram of FIG. 2.

Referring to FIG. 1, FIG. 2, and FIG. 3, the high density electrical connector 100 is disposed on the printed circuit board 200. The printed circuit board 200 has a plurality of contact points 210. The terminal channels 130 in the connector body 110 are disposed corresponding to the contact points 210 respectively. The terminal channels 130 are divided by a plurality of dividing walls 132 disposed between two terminal channels 130. A position and a shape of the terminal channel 130 may be bound by the dividing walls 132.

Each terminal 140 may include a main portion 142, at least an elastic arm 146, and an extending portion 145. The extending portion 145 is extended from a side of the main portion 142 near to the printed circuit board 200 to electrically connect with the contact points 210 of the printed circuit board 200.

In FIG. 3, each dividing wall 132 for dividing the terminal channels 130 has a shoulder 134 disposed on the side of the dividing wall 132 far to the printed circuit board 200. The shoulder 134 of the dividing wall 132 is an incline inclining to the terminal channel 130 and an opening of the terminal channel 130 far to the printed circuit board 200 is larger to an opening of the terminal channel 130 near to the printed circuit board 200 and form a neck at the opening of the terminal channel 130. In this embodiment, each terminal 140 has two elastic arms 146 and each dividing wall 132 near the elastic arm 146 has the shoulder 134. However, if each terminal 140 has only one elastic arm 146, the dividing wall 132 may have only one shoulder 134.

Figure 4:
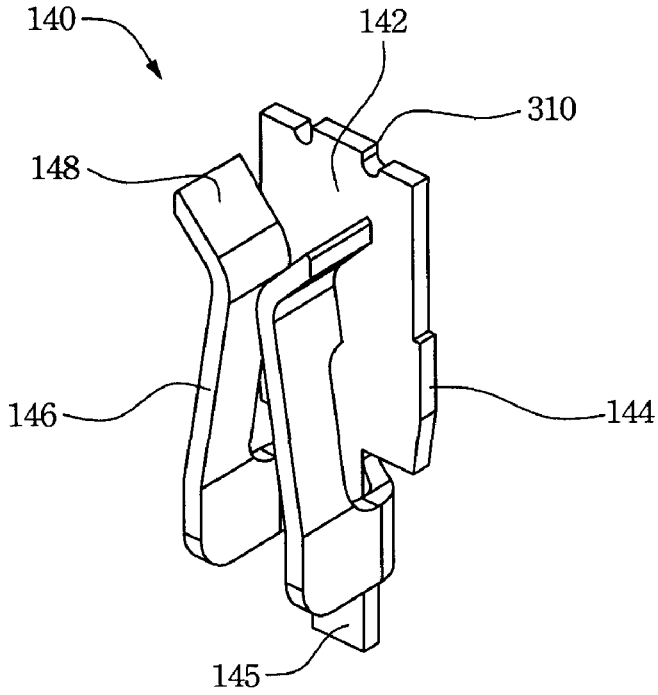
FIG. 4 is an oblique view diagram of an embodiment of a terminal of the invention.

Refer to FIG. 4. FIG. 4 illustrates an oblique view diagram of an embodiment of a terminal of the invention. The elastic arm 146 of the terminal 140 may be elastically deformed and have a guiding portion 148 extended. The guiding portion 148 of the terminal 140 is extended from the elastic arm 146. The guiding portion 148 of the elastic arm 146 may be inserted into the neck of the diving wall 132 of the terminal channel 130 to be closer to the shoulder 134 when the terminal 140 is in a free state, that is, the elastic arm 146 of the terminal 140 has not been elastically deformed. Thus the guiding portion 148 of the end of the elastic arm 146 may approach the shoulder 134 of the dividing wall 132.

Figure 5:
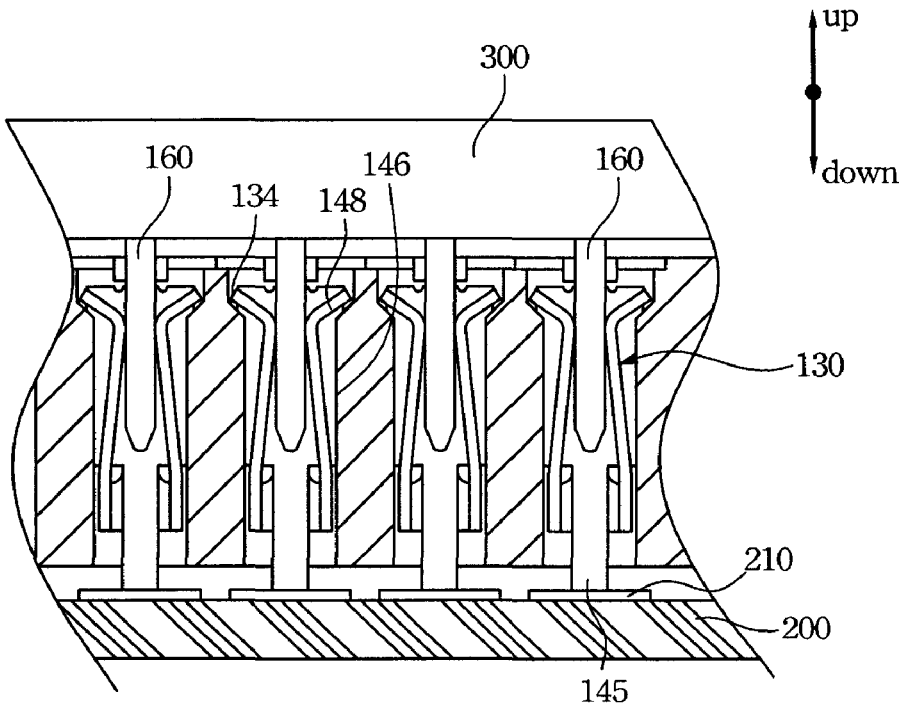
FIG. 5 is a schematic diagram of the invention for an embodiment of the electrical connector butted with an electronic device.
Figure 6:
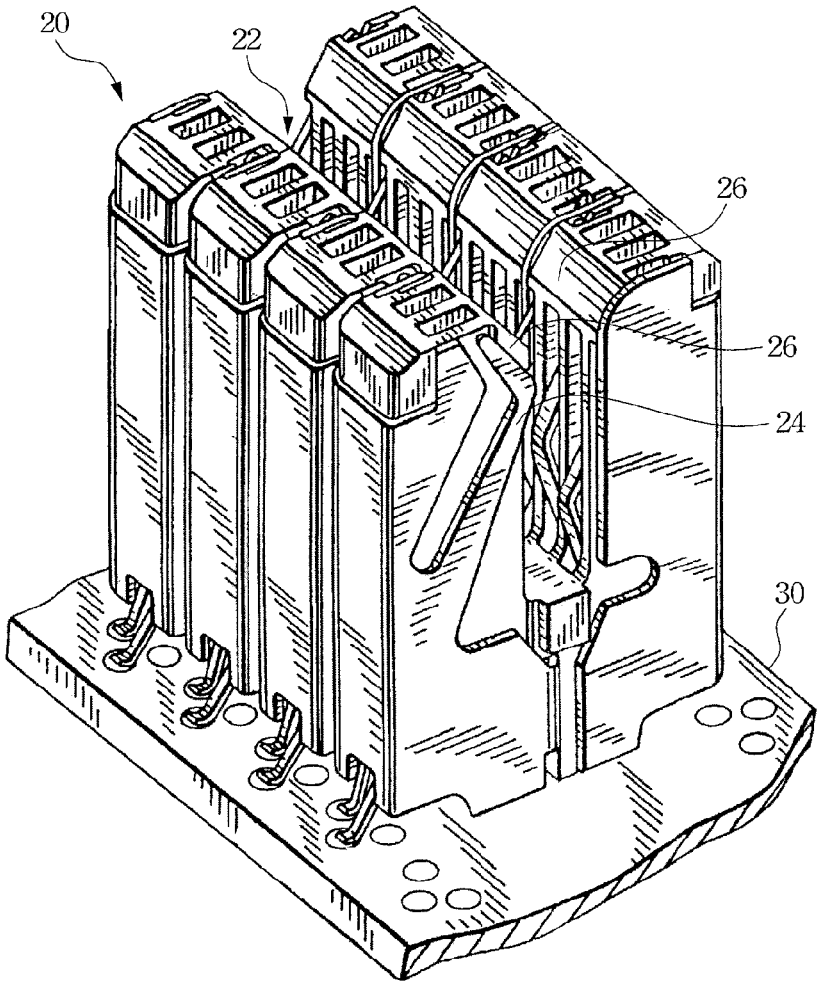
Fig. 6 (PRIOR ART)
FIG. 6 is a schematic diagram of a conventional electrical connector.
Figure 7:
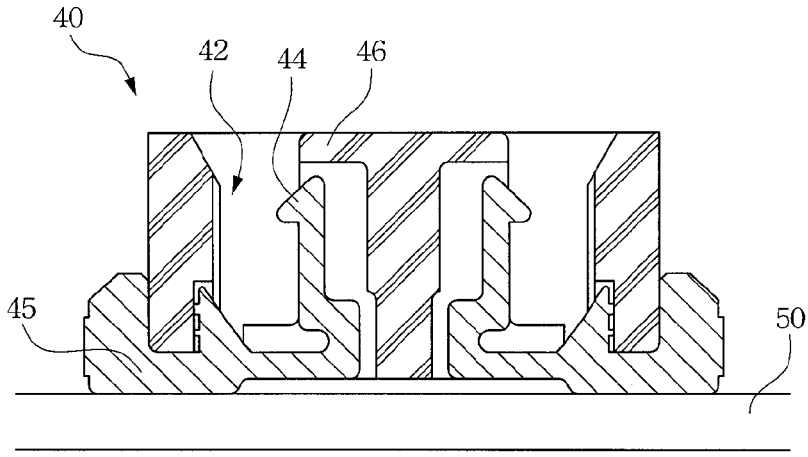
Fig. 7 (PRIOR ART)
FIG. 7 is a schematic diagram of another conventional electrical connector.
Figure 8:
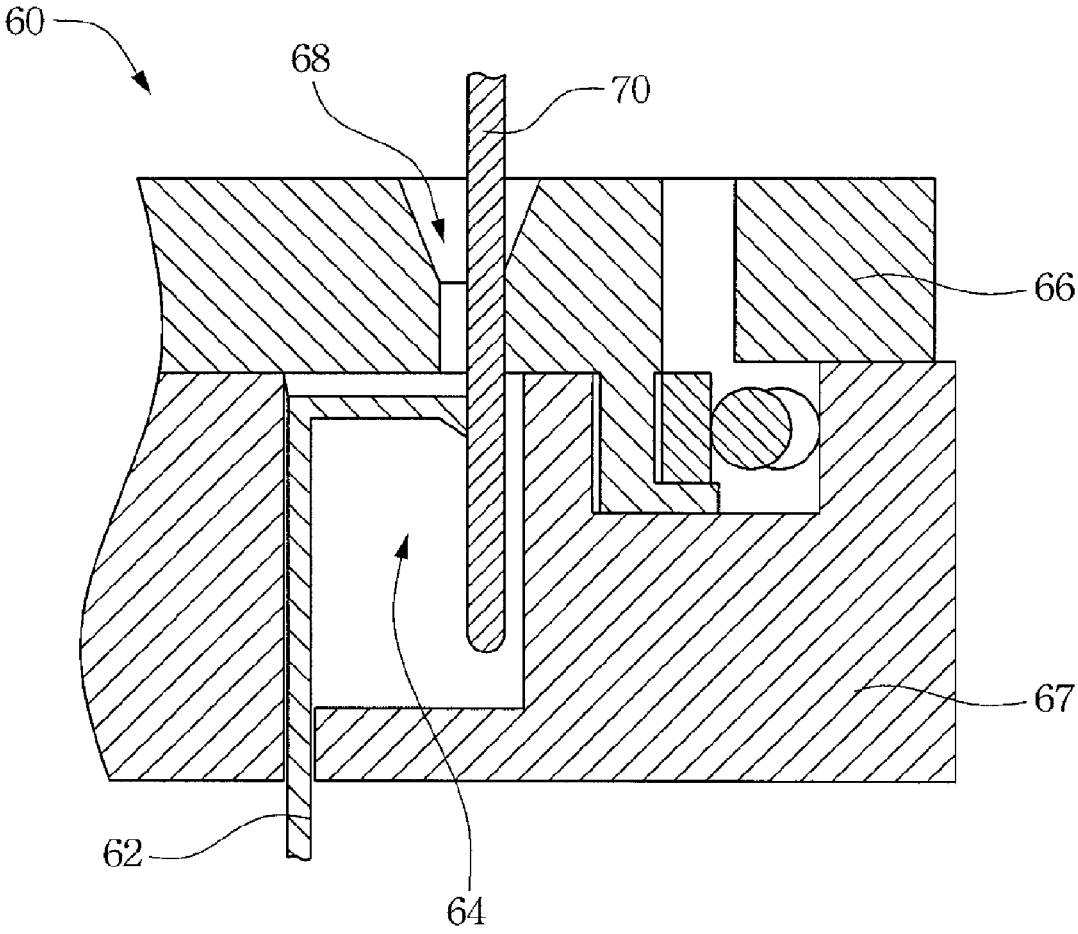
Fig. 8 (PRIOR ART)
FIG. 8 is a schematic diagram of another conventional electrical connector for CPU.

Refer to FIG. 5. FIG. 5 illustrates a schematic diagram of the invention for an embodiment of the electrical connector 100 butted with an electronic device 300 having a plurality of terminals 160. The guiding portion 148 of the terminal 140 is near the shoulder 134 of the dividing wall 132. The elastic arm 146 and the guiding portion 148 may be elastically deformed when the terminal 160 of the electronic device 300 is inserted into the terminal channel 130 and the guiding portion 148 of the terminal 140 may further approach the shoulder 134 of the dividing wall 132. If the terminal 160 of the electronic device 300 is slantwise inserted into the terminal channel 130, the guiding portion 148 may be forced to come into contact with the inclined shoulder 134 of the dividing wall 132. A normal force support received from the guiding portion 148 and the shoulder 134 may adjust the terminal 160 of the electronic device 300 to be inserted into the terminal channel 130.

The electronic device 300 may have a pin grid array (PGA) and the terminal 160 is a pin terminal in the embodiment. The electronic device 300 may also have a ball grid array (BGA) and the terminal 160 is a ball terminal in such embodiment.

The terminal 140 may extend an interfering portion 144 from two side of the main portion 142 respectively. The interfering portion 144 may interfere with the dividing wall 132 to keep and hold the terminal 140 in the terminal channel 130. The interfering portion 144 of the terminal 140 is slightly larger than a distance between the dividing walls 132 and the interfering portion 144 may interfere with the dividing wall 132 to keep and hold the terminal 140 in the terminal channel 130 in the embodiment but not limited. The high density electrical connector 100 may have a position structure to fix the high density electrical connector 100 on the printed circuit board 200 precisely. The position structure includes a position plug 150 disposed on a bottom of the connector body 110 and a position cavity 220 disposed on the printed circuit board 200 corresponded. The high density electrical connector 100 may be fixed on the printed circuit board 200 precisely by coupling the position plug 150 and the position cavity 220. Although the present invention has been described in considerable detail with reference certain preferred embodiments thereof, other embodiments are possible. For example, the position structure may have different shapes and arrangements. Therefore, their spirit and scope of the appended claims should no be limited to the description of the preferred embodiments container herein.

The extending portions 145 of the terminal 140 may be welded on a plurality of contact points 210 of the printed circuit board 200 respectively by a surface mount technique. The extending portion 145 may also be bent and welded on the contact point 210. The extending portion 145 may be bent and made parallel with the printed circuit board 200 and inserted into the terminal channel 130. The extending portion 145 may also be inserted into the terminal channel 130 and bent to be made parallel to the printed circuit board 200.

Refer to FIG. 2, FIG. 3, and FIG. 4. The integration of the electronic device is increasing with the increasing density of the terminals 140 contacted with the contact points 210. The smoothness and accuracy of mounting the extending portion 145 with the contact points 210 becomes an important part of manufacturing the high density electrical connector 100. Following discloses an embodiment of a method for assembling the terminals 140 into the connector body 110 of the high density electrical connector 100 of the invention. The method may assemble the connector body 110 with the terminals 140 connected with a carrier. The method includes inserting the terminals 140 into the terminal channels 130 of the connector body 110 respectively from the top of the connector body 110 far to the printed circuit board 200, wherein the terminals 140 are connected on an end of the carrier far to the printed circuit board 200; separating the terminals 140 and the carrier; and mounting the terminals 140 and the printed circuit board 200 to generate the electrical connection. Separating the terminals 140 and the carrier further includes generating a joint 310 disposed on the side of each terminal 130 far to the printed circuit board 200. Mounting the terminals 140 and the printed circuit board 200 further includes bending the extending portion 145 disposed of each terminal 140 near to the printed circuit board 200 and mounting the extending portion 145 with the contact point 210 of the printed circuit board 200. The extending portion 145 is formed on the terminal 140 directly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A high density electrical connector disposed on a surface of a printed circuit board for electrically connecting an electronic device and the printed circuit board, the high density electrical connector comprising:

a connector body having a plurality of terminal channels, wherein each terminal channel is defined by two dividing walls of the connector body, which extend from a side near the printed circuit board to an opposite side, wherein each dividing wall has a shoulder disposed a distance away from the printed circuit board in a terminal channel; and a plurality of terminals disposed in the terminal channels respectively, wherein each terminal comprises at least one elastic arm each having a guiding portion extending toward the shoulder of the dividing wall, and the elastic arm is supported by the shoulder of the dividing wall.

2. The high density electrical connector of claim 1, wherein each shoulder of the dividing wall forms an incline within the terminal channel.

3. The high density electrical connector of claim 1, further comprising a position pin and a position cavity disposed on the connector body and the printed circuit board respectively to fix the connector body and printed circuit board by coupling the position pin and the position cavity.

4. The high density electrical connector of claim 1, wherein the printed circuit board comprises a plurality of contact points, each terminal comprises a main portion and the main portion has an extending portion extending toward the printed circuit board for electrically connecting with the contact points.

5. The high density electrical connector of claim 4, wherein the extending portion is mounted on the contact points of the printed circuit board.

6. The high density electrical connector of claim 4, wherein each terminal has a carrier joint disposed on the side opposite the printed circuit board.

7. The high density electrical connector of claim 4, wherein each terminal has an interfering portion extending from the main portion to interfere with the dividing walls of the connector body to secure the terminals in the terminal channels.

8. The high density electrical connector of claim 7, wherein the electronic device to be connected has a plurality of terminals and the terminals of the electronic device are inserted into the terminal channels of the high density electrical connector to engage the elastic arms for electrically connecting the electronic device and the printed circuit board through the high density electrical connector.

* * * * *